United States Patent [19]

Wilson

[11] 4,256,083

[45] Mar. 17, 1981

[54] FIREBOX

[76] Inventor: Charles P. Wilson, R.D. #8, Box 278, Elkton, Md. 21921

[21] Appl. No.: 1,454

[22] Filed: Jan. 8, 1979

[51] Int. Cl.[3] ..... F24B 7/00

[52] U.S. Cl. ..... 126/121; 126/138; 126/289; 237/51

[58] Field of Search ..... 126/121, 131, 138, 139, 126/123, 288, 289; 237/51; 165/179; D7/206, 208

[56] References Cited

U.S. PATENT DOCUMENTS

| | | | |
|---|---|---|---|
| 1,313,085 | 8/1919 | Greene | 126/121 |
| 1,681,449 | 8/1928 | Walters | 126/121 |
| 1,697,635 | 1/1929 | Cornelius | 237/51 X |
| 2,223,763 | 12/1940 | Heinz | 126/121 |
| 3,267,564 | 8/1966 | Keyes | 165/179 |
| 3,845,754 | 11/1974 | Wilkening | 126/121 |
| 4,095,581 | 6/1978 | Billmeyer et al. | 126/121 |
| 4,112,915 | 9/1978 | Slavik | 126/121 |
| 4,120,281 | 10/1978 | Wass | 126/121 |
| 4,136,665 | 1/1979 | Steffen | 126/123 |
| 4,174,701 | 11/1979 | Gneiting | 126/121 |

*Primary Examiner*—Samuel Scott
*Assistant Examiner*—Randall L. Green

[57] ABSTRACT

The device of this invention is an enclosed firebox constructed to fit in a wall fireplace cavity such that the front piece of the enclosed firebox faces the room interior while the back piece faces the outdoors. The front piece contains duct openings to emit heated air from within the firebox into the room. The openings can be closed off to prevent air flow from either into or out of the room. The heated air is obtained from air outside the room to be heated.

7 Claims, 5 Drawing Figures

FIREBOX

FIELD OF THE INVENTION

This invention relates to a fireplace unit, and more specifically to an enclosed firebox which fits into a wall cavity.

BACKGROUND OF THE INVENTION

In the usual fireplace structure, room air is drawn into the combustion chamber, and, after combustion, is passed up the chimney duct. Furthermore, after the fire in the chamber dies down, room air continues to pass through the chamber and up the duct. Both of these room air movements can cause large heat loss from the room. It would be beneficial to have a structure which does not depend upon room air for conbustion and which also prevents heat loss from the room after combustion in the structure has substantially ceased. The device of this invention achieves these desired results.

SUMMARY OF THE INVENTION

The device is a firebox which comprises:

(a) an enclosed combustion chamber adapted to fit into a fireplace wall cavity which has a flue, (b) said chamber having a front piece adapted to cover the opening of the wall cavity and to fit against said wall to provide an air-tight seal, said front piece containing a heat resistant transparent panel, (c) said chamber having means for drawing air from outdoors, for heating said air inside the chamber, and for directing the heated air into the room containing the fireplace wall cavity and means for exiting combustion gases to the flue, (d) optionally, said chamber having a back piece which contains an opening to the outdoors, and having means connected to said opening to close-off the interior of the chamber from the outdoors.

DESCRIPTION OF THE INVENTION

The device of this invention is an enclosed firebox constructed to fit in a wall fireplace cavity such that the front piece of the enclosed firebox faces the room interior while the backpiece faces the outdoors. The front piece contains duct openings to emit heat from within the firebox into the room. The openings can be closed off to prevent air flow from either into or out of the room. When closed, the front piece effectively seals off the room air from air inside the fire box. The fire inside the fireplace is enjoyed by occupants of the room by use of a transparent heat resilient panel in the frontpiece.

Figure 1:
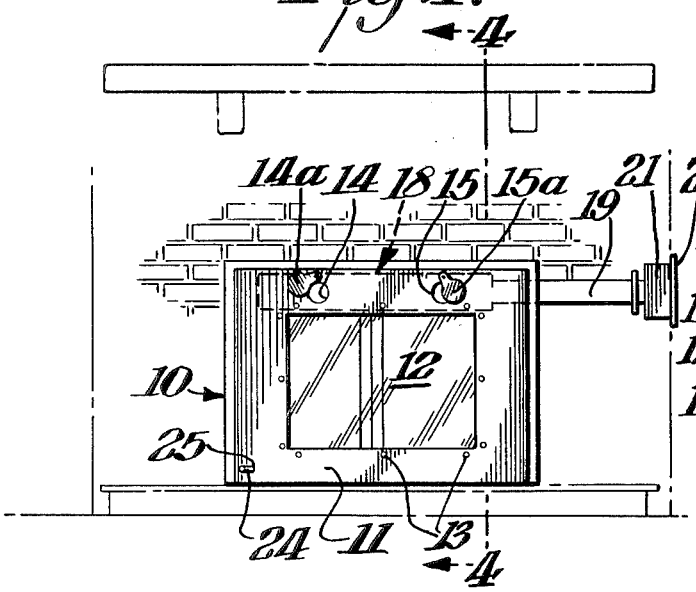
FIG. 1 is a view of the front piece of the firebox of this invention in place in a fireplace wall cavity with a a cutaway section showing air entry means from the outdoors.
Figure 4:
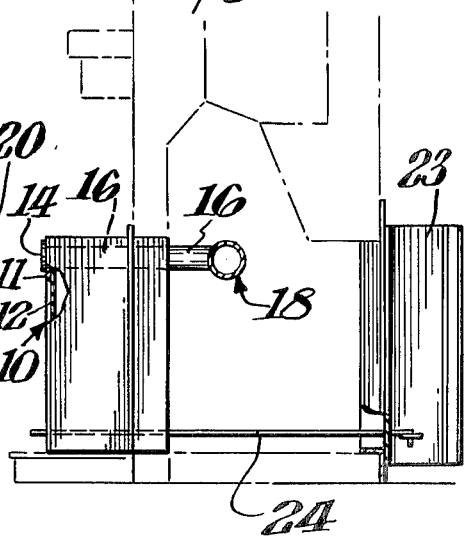
FIG. 4 is a side view of the firebox taken along line 4—4 of FIG. 1.

Referring now to the drawings, FIG. 1 depicts the view of the firebox as seen from within the room. Front piece 10 comprises a heat resilient support structure 11 which is cut out so that the interior of the firebox can be seen through a transparent heat resilient member 12 (usually glass) which covers the cut out. Fasteners 13 fasten member 12 to the support structure. Heat from within the firebox is emitted into the room through openings 14 and 15 in support structure 11. Opening 14 is depicted with movable sealing cover 14a in open position, while opening 15 is depicted with movable sealing cover 15a in almost closed position.

Figure 2:
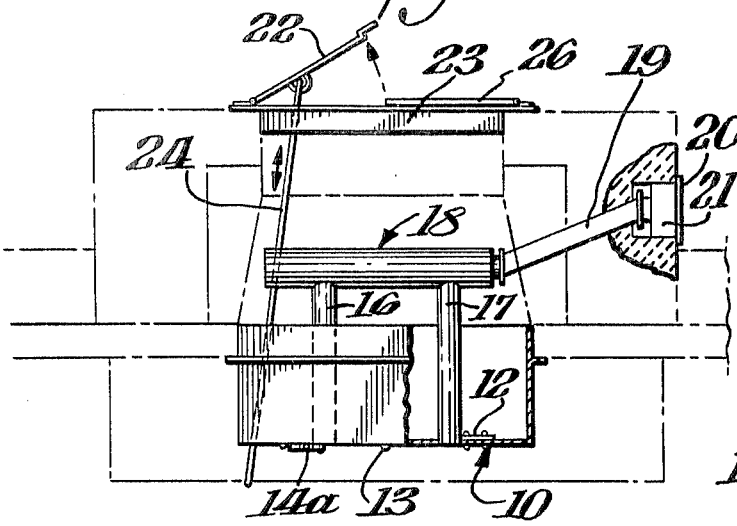
FIG. 2 is a top view of the firebox shown in FIG. 1, with a cutaway section.

FIG. 2 shows the firebox from the top in which the top cover of the enclosed device has been removed. Front piece 10 is shown attached to two air ducts 16 and 17 which connect openings 14 and 15 in front piece 10 with air heating chamber 18 inside the firebox. Chamber 18 is located above the combustion source inside the firebox. Air from outdoors is entered into heating chamber 18 through duct 19 and entry opening 20. Entry opening 20 is preferably equipped with an intake fan 21 to aid in drawing air into the heater chamber.

Figure 3:
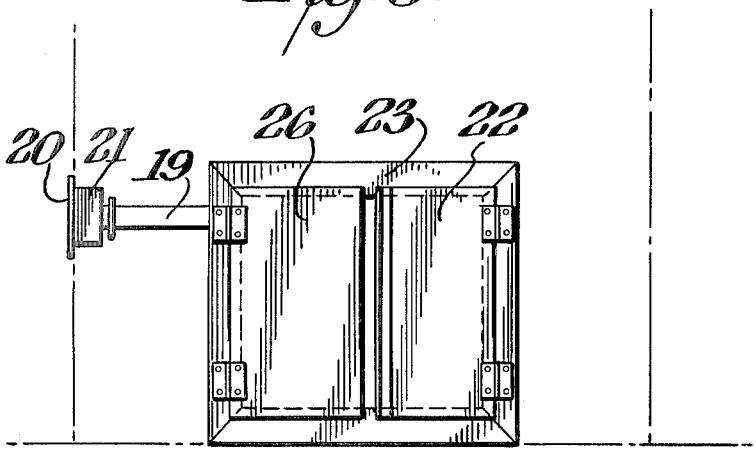
FIG. 3 is a view of the optional back piece of said fire box with a cutaway section showing the air entry means.

Air to provide oxygen for the source of combustion within the firebox is supplied in one embodiment of this invention by opening door 22 in back piece 23 (shown in FIG. 2 and 3). Door 22 can be opened from within the room by means of movable pole 24 which is connected to door 22 and which extends through front piece 10 at notch 25 (shown in FIG. 1).

Door 26 in back piece 23 can be opened along with door 22 in order to add fuel (such as logs) to the fire box or to remove spent fuel (such as ashes). Alternatively, transparent heat-resilient member 12 can be equipped to be movable to permit entry of fuel into the firebox.

Figure 5:
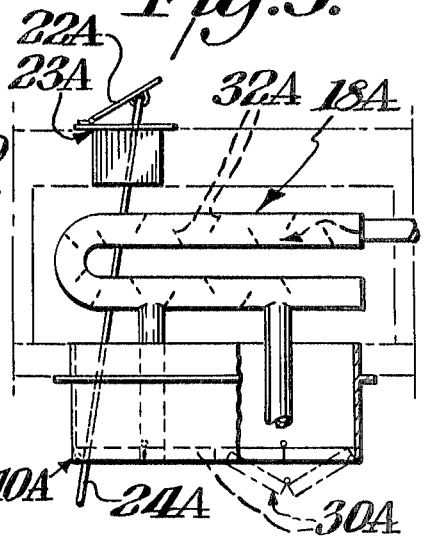
FIG. 5 is an alternate view of the firebox.

FIG. 5 depicts an alternative embodiment of this invention wherein the backpiece is solid, i.e., has no doors and in which the front piece contains movable doors. Specifically, front piece 10A is depicted with movable doors 30A which can be transparent or non-transparent. Pole 24A operates closure member 22A in backpiece 23A to provide air for combustion when doors 30A are closed or partially closed.

FIG. 5 also depicts another varient of this invention which can be employed in all the embodiments described hereinbefore. This varient is in the construction of air heating chamber 18. As shown in FIG. 5, air heating chamber 18A contains in its interior, a series of baffles or air deverter vanes 32A which serve to increase the mixing of hot and cool air to insure uniformity of temperature. The chamber 18A is depicted as U-shaped in FIG. 5 but such shape is only one of several that can be employed.

The container is preferably an elongated tube or cylinder of sufficient length to allow the air inside to become heated as it passes from the outside to the room interior.

Having described the preferred embodiment of the invention and its operation, it is apparent that modifications could be made without departing from the spirit and scope thereof.

I claim:

1. A fire box for use in a fireplace which comprises:

(a) an enclosed combustion chamber adapted to fit into a fireplace wall cavity which has a flue, (b) said chamber having a front piece adapted to cover the opening of the wall cavity and to fit against said wall to provide an air-tight seal, said front piece containing a heat resistent transparent panel, (c) said combustion chamber having duct means connected to said front piece and to the outdoors for drawing air from outdoors and directing said air into the room containing the fireplace wall cavity, (d) said chamber having a rearwardly positioned door which contains an opening to the outdoors for the entry of air to the combustion chamber and means connected to said opening to close-off the interior of the chamber from the outdoors and said door being adapted for loading of combustible material to the combustion chamber, and (e) flue means for exiting combustion gases to the flue;

Wherein, combustion within the combustion chamber heats said duct means thereby heating air within said duct means and said heated air is directed into the room containing the fireplace wall cavity.

2. The firebox of claim 1 wherein the duct means for drawing air from outdoors comprises a duct leading from the outdoors into the chamber, and a fan constructed and positioned to draw air into the duct.

3. The firebox of claim 2 wherein the means for heating the air from outdoors is a container connected to the duct described in claim 2 which is positioned above a source of combustion in the chamber.

4. The firebox of claim 3 wherein the duct means for conveying the heated air through the front piece of the chamber comprises at least one duct connecting the container described in claim 3 with at least one opening in said front piece.

5. The firebox of claim 4 wherein each opening is said front piece described in claim 4 can be closed by means of a movable sealing cover.

6. The firebox of claim 3 wherein the container contains air-deflecting baffles.

7. The firebox of claim 1 wherein the panel of the front piece is affixed thereon in the form of a door.

* * * * *